US006557469B1

(12) United States Patent
Schneider et al.

(10) Patent No.: US 6,557,469 B1
(45) Date of Patent: May 6, 2003

(54) PRINTING CYLINDER HAVING PLATE SECURING DEVICE INCLUDING PLATE LEG FASTENING ELEMENTS AND A ROLLER BODY

(75) Inventors: Georg Schneider, Würzburg (DE); Karl Robert Schäfer, Rimpar (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/926,646

(22) PCT Filed: May 25, 2000

(86) PCT No.: PCT/DE00/01699

§ 371 (c)(1),
(2), (4) Date: Nov. 28, 2001

(87) PCT Pub. No.: WO00/73074

PCT Pub. Date: Jul. 12, 2000

(30) Foreign Application Priority Data

May 29, 1999 (DE) ..... 199 24 784

(51) Int. Cl.[7] ..... B41F 27/12
(52) U.S. Cl. ..... 101/415.1; 101/378

(58) Field of Search ..... 101/415.1, 409, 101/378

(56) References Cited

U.S. PATENT DOCUMENTS 2,973,710 A * 3/1961 Hantscho ..... 101/415.1
5,010,818 A * 4/1991 Wallschlaeger, Sr. .... 101/415.1

FOREIGN PATENT DOCUMENTS

| | | |
|---|---|---|
| DE | 38 12 137 A1 | 1/1989 |
| DE | 43 35 140 C1 | 2/1995 |
| DE | 196 36 412 C1 | 1/1998 |
| FR | 1499664 | 9/1967 |
| GB | 2 206 534 A | 5/1988 |

* cited by examiner

*Primary Examiner*—Leslie J. Evanisko
(74) *Attorney, Agent, or Firm*—JonesTullar & Cooper PC

(57) ABSTRACT

A device for fixing a flexible plate having angled or beveled suspension edges to a cylinder utilizes a plurality of fastening elements located in a cylinder groove situated radially inwardly of a fastening slit. The fastening elements are engageable with the suspension legs under the influence of spring forces. Separate fastening elements can be used to engage the leading plate suspension leg depending on the direction of rotation of the cylinder.

8 Claims, 3 Drawing Sheets

PRINTING CYLINDER HAVING PLATE SECURING DEVICE INCLUDING PLATE LEG FASTENING ELEMENTS AND A ROLLER BODY

FIELD OF THE INVENTION

The present invention is directed to devices for fixing a flexible plate on a cylinder of a rotary printing press. The flexible plate has suspension legs which fit into a cylinder groove. Several fastening elements for the suspension legs are positioned in the cylinder groove. One of the suspension leg fastening elements may include a jamming roller.

DESCRIPTION OF THE PRIOR ART

A device for fixing a flexible printing plate on the forme cylinder of a rotary printing press having at least one cylinder groove extending in the axial direction is known from DE 43 35 140 C1.

A first, or leading suspension leg, which is beveled at an acute angle, is suspended at an edge of the first groove wall of the cylinder groove of the forme cylinder. A second, or trailing, suspension leg can be placed against the second groove wall, which second groove wall is extending approximately in the radial direction of the forme cylinder, of the cylinder groove. The cylinder groove contains a spindle which is pivotable around its axis. Two leaf springs, each of which is distributed over the width of the printing plate, are fastened on the spindle and can be brought into, or out of contact with the suspension legs in the course of pivoting the spindle.

DE 196 36 412 C1 discloses a cylinder on which pressure cams for clamping both suspension legs of a printing plate are arranged on a pivotable shaft.

SUMMARY OF THE INVENTION

The object of the present invention is directed to providing a device for fixing a flexible plate on a cylinder of a rotary printing press.

In accordance with the present invention, this object is attained by providing the plate receiving cylinder with a cylinder groove which is accessed through a fastening slit. Suspension legs of the flexible plate are received in the fastening slit where they are engaged by fastening elements. One of the suspension legs can be fastened against an abutment in the cylinder groove wall by one of the fastening elements. Another of the fastening elements is a pivotable flap with a jamming roller arranged between the flap and one of the plate suspension legs.

The advantages to be obtained by the present invention consist, in particular, in that a rugged, simply constructed device is created, which can be produced cost-effectively. The device in accordance with the present invention can be displaced without the turning of a spindle in only two positions. A further advantage of the present invention lies in that in its axial extension it can consist of several short base bodies. It is possible because of this to remove the device laterally piece by piece from the cylinder groove, for example for maintenance purposes, without having to dismount the cylinder from the lateral frame. It is of particular advantage that the device can also be employed in case of a reversal of the direction of rotation of the cylinder supporting the plates, for example in connection with satellite printing units. An automatic plate feeding and removal by the use of known devices is possible.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
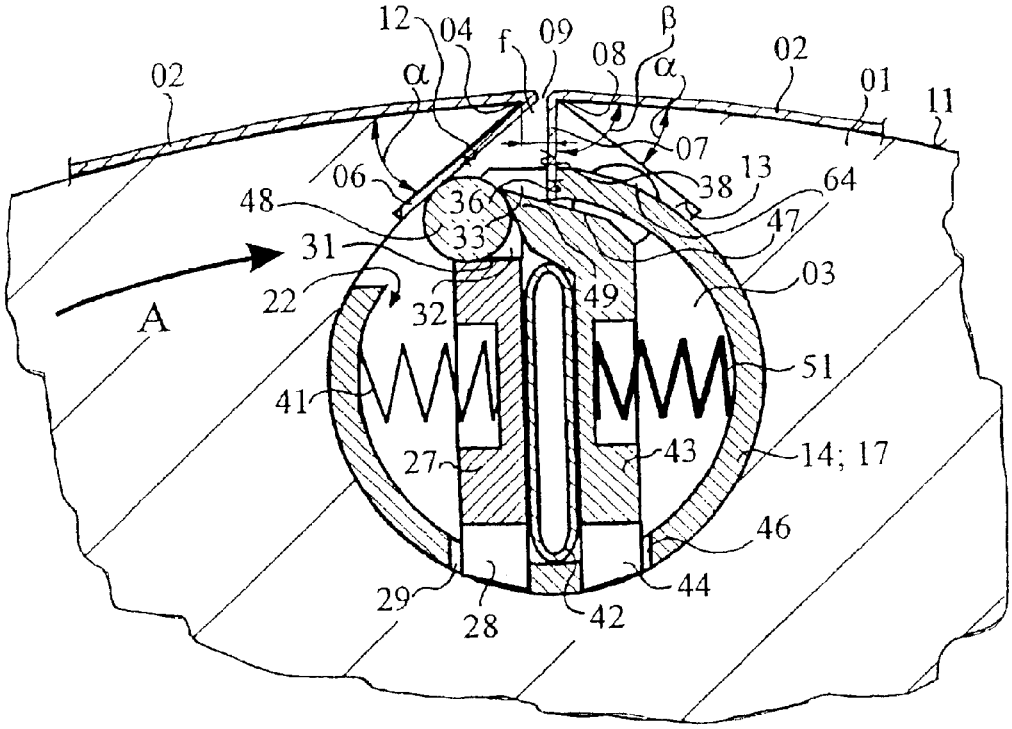
FIG. 1, a sectional view, taken along line I—I of FIG. 4, with the cylinder, the plate and the air hose in a plate-holding or rest position and in an enlarged scale, FIG. 2, a sectional view taken along line II—II of FIG. 4, with the cylinder, the plate and the air hose in an enlarged scale, FIG. 3, a sectional view analogous to FIG. 1, with the device in a plate-removing or operating position, and in FIG. 4, a view from above on the device, without the cylinder and without the air hose in a partial enlarged representation and limited in the axial direction.

For receiving flexible plates 02, a cylinder 01, for example a plate or rubber blanket cylinder of a rotary printing press, is provided with at least one cylinder groove 03 extending in the axial direction. At a front edge 04, pointing in the production direction A of the cylinder 01, which cylinder 01 turns toward the right, or in a clockwise direction of rotation, the cylinder groove 03 will receive a front, or "leading", beveled suspension leg 06 of the plate 02 with an opening angle $\alpha$. The plate 02 furthermore has a rear, or "trailing" beveled suspension leg 07, which is suspended from a second, rear edge 08 of the same cylinder groove 03 and which has an approximately right opening angle $\beta$, all as may be seen in FIG. 1.

It is also possible to arrange two plates, for example two printing plates, on the circumference of the cylinder 01. In this case, two diametrically opposing cylinder grooves are required in the circumferential direction of the cylinder 01.

An acute opening angle $\alpha$, for example of up to 45°, is formed between the surface 11 of the cylinder 01 and a first cylinder wall 12 of the cylinder groove 03. A second cylinder groove wall 13 also has an acute opening angle $\alpha$ in respect to a peripheral or circumferential surface 11 of cylinder 01. Both edges 04, 08, which are also vertex points of the opening angles $\alpha$, are separated by, and define a fastening slit 09.

Figure 2:
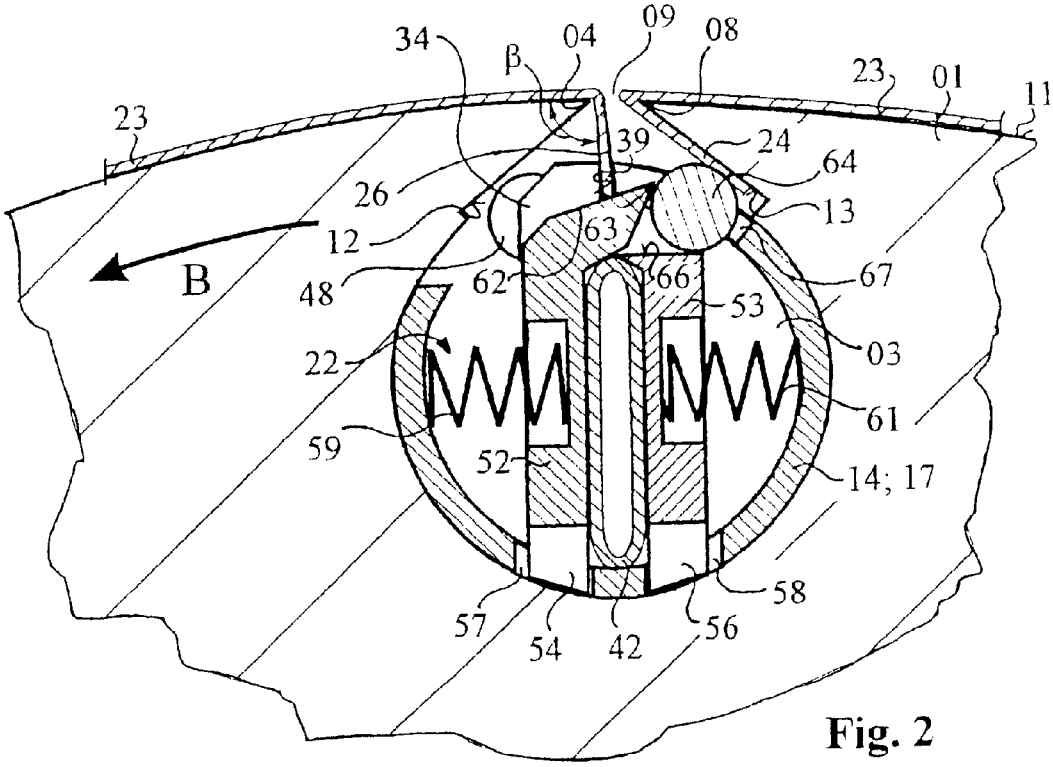

It is possible to also suspend a plate 23 by its suspension legs 24, 26 on the cylinder 01 in such a way that its "leading", acute-angled suspension leg 24 is suspended at the edge 08, and its "trailing", approximately right-angled suspension leg 26 is suspended at the edge 04, as seen in FIG. 2. Therefore the "leading" suspension leg 24 points in the production direction B toward the left, i.e. in a counter-clockwise direction of rotation.

The fastening slit 09 is embodied so that its inner width f is sufficient such that at least two suspension legs 06, 07, which project into the cylinder groove 03, can be placed therein next to each other.

In place of a printing plate or several printing plates placed next to each other, it is possible to also fasten flexible support plates with rubber blankets arranged on them on cylinder 01.

The cylinder groove 03 can be approximately circular in cross section and is connected with the cylinder surface 11 through the fastening slit 09.

Figure 4:
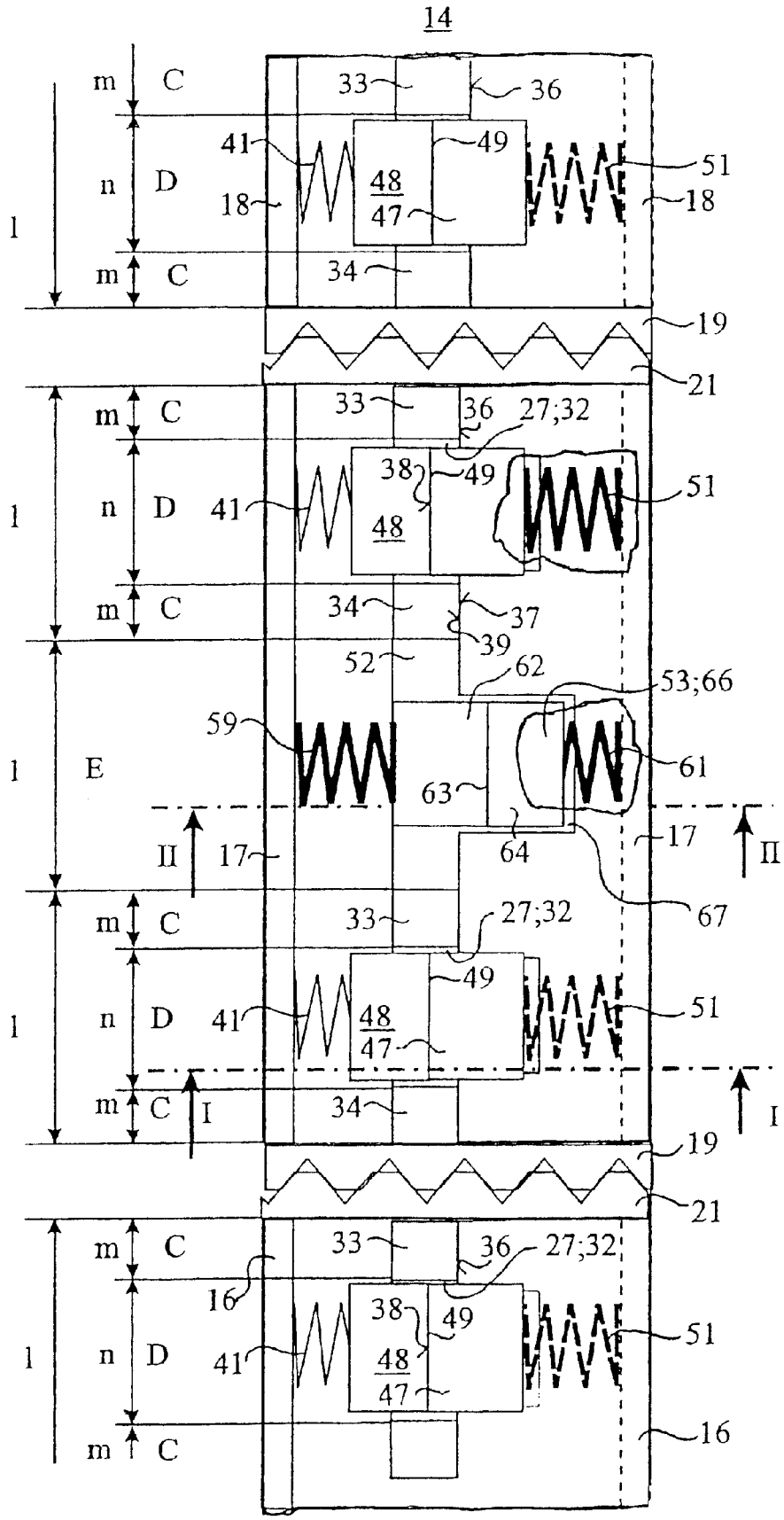

A base body 14, which is open in the direction toward the fastening slit 09, is arranged in the cylinder groove 03 and has, for example, a cross section in the form of a longitudinally cut tube so that it is channel-shaped. In accordance with an embodiment represented in FIG. 1 and also in FIG. 4, this base body 14 can consist, in the axial direction, of several short base bodies 16, 17, 18, which can be coupled with each other. Only three such short base bodies are represented in FIG. 4. Such a coupling of the short base bodies can act interlockingly, for example, and can be implemented by sets of teeth 19, 21 on both ends of the short base bodies 16, 17, 18. The two outer sets of teeth 19, 21 can be fixed in place at the cylinder end faces by the provision an end coupling element, not specifically represented.

A number of different clamping and/or jamming elements C, D, E are arranged in the interior 22 of each base body 14, or 16 to 18, such as shown by the example of the base body 17 in FIG. 4, and as described, as follows:

first clamping and/or jamming elements C for the "trailing" suspension leg 07, 26, which "trailing" suspension leg has an approximately right-angled opening angle β, second clamping and/or jamming elements D for a suspension leg 06, which is beveled at an acute angle α and is "leading" in the production direction A toward the right, as seen in FIG. 1, third clamping and/or jamming elements E for a suspension leg 24, which is beveled at an acute angle and is "leading" in the production direction B toward the left, as seen in FIG. 2.

The channel-shaped base body 14, or the short base bodies 16 to 18, can be embodied to be C-shaped, U-shaped, round, oval or polygonal in cross section. The cross section of the cylinder groove 03 is matched to the respective cross section of the base body 14, or short base bodies 16 to 18.

The cross section of the base body 14, or short base bodies 16 to 18 represented in FIGS. 1 and 2 is embodied in a C-shape. One of its openings points approximately in the direction of the fastening slit 09. The above described clamping and/or jamming elements, which are arranged so that they can be brought into or out of operating connection with the suspension legs 6, 7, or 24, 28, project through the opening facing slit 09.

The first clamping and/or jamming elements C consist of a first flap 27, which is pivotably seated in the base body 14 or 16 to 18 and whose longitudinal axis extends in an axis-parallel direction, and whose vertical axis extends in the radial direction in respect to the cylinder 01. A lower end 28 of the first flap 27, which is remote from the cylinder surface, enters into a slit 29 of the respective base body 14, or 16 to 18, and in this way forms a pivot bearing.

Figure 3:
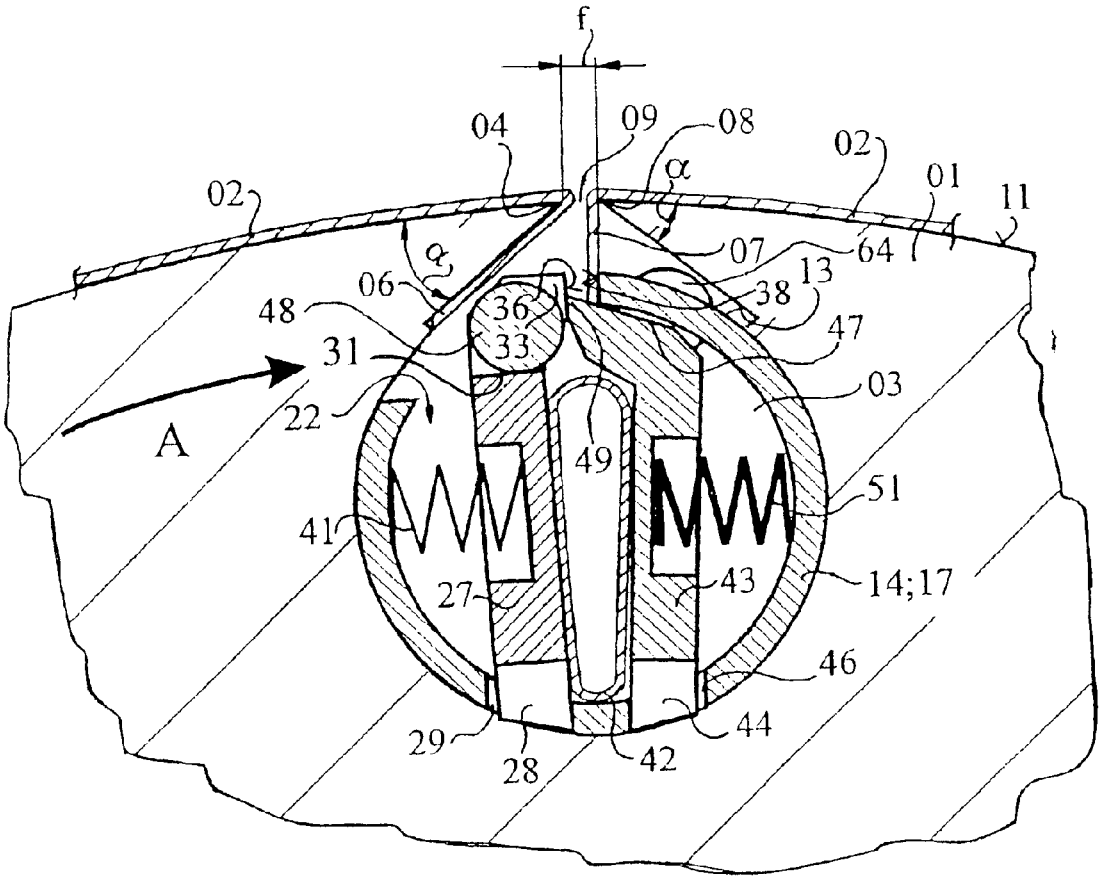

The first flap 27 has an axial length l, as seen in FIG. 4, which corresponds approximately to one-third of the total axial length of a base body 16, 17 or 18. An upper end 31 of the first flap 27, which is close to the cylinder surface, has a cutout 32, which is bounded on both sides by a respective arm 33, 34. Each arm 33, 34 has an axial length m with a jamming surface 36, 37. The axial length m corresponds approximately to one-fourth of the total axial length l of the flap 27. Each of the jamming surfaces 36, 37 is in an operational connection with a respective jamming surface of an abutment 38, 39 of the base body 14, or of the respective short base bodies 16 to 18, as shown in FIGS. 1 and 4. The jamming surfaces of the abutment 38, 39 are located, in the radial direction, below the fastening slit 09. As represented in FIGS. 2, 3, the arms 33, 34 of the flap 27 can be bent off, approximately at right angles, pointing in the direction of the abutment 38, 39.

The pivotable first flap 27 can be brought from a plate-holding position into a plate-removing position against the force of a spring 41, for example a compression spring fixed in place on the base body.

Actuation of the pivotable first flap 27 takes place by operation of an inflatable air hose 42, which will be described in detail later.

The second clamping and/or jamming elements D for a beveled suspension leg 06 of the plate 02 "leading" toward the right in the production direction A consist of a second flap 43, which is pivotably seated in the base body 14 or short base bodies 16 to 18 and extends, spaced at a distance by the air hose 42, parallel with the flap 27, as seen in FIG. 1. A lower side 44 of this second flap 43 enters into a slit 46 of the respective base body 14, or the short base bodies 16, or 18, and constitutes a pivot bearing.

The second flap 43 has an axial length of n, as shown in FIG. 4. This axial length approximately corresponds to the length of the cutout 32, and to twice the axial length m.

The top 47 of the second flap 43, which is near the cylinder surface, is bent at approximately right angles in the direction toward the first groove wall 12, and its edge 49 projects into the cutout 32 of the flap 27 located between the arms 33, 34. A roller body, for example a jamming roller 48, is maintained in the cutout 32, and will be pressed against the "leading" suspension leg 06 resting against the first groove wall 12, by the edge 49 of the flap 43 in response to the force of a spring 51, for example a compression spring fixed in place on the base body.

Release or disengagement of the pivotable second flap 43 takes place by inflation of the inflatable air hose 42 located between the two flaps 27, 43, which can pivot, i.e. open, both flaps 27, 43 against the force of the springs 41, 51.

The third clamping and/or jamming elements E for a beveled suspension leg 06 of the plate 23 "leading" toward the left in the production direction B, as seen in FIG. 2, consist of a third flap 52, which is pivotably seated in the base body 14 or short base bodies 16 to 18 and is of a length l. A fourth flap 53 of equal length extends parallel with the third flap 52 and is kept at a distance by the air hose 42. Both flaps 52, 53 are respectively seated at their lower ends 54, 56, i.e. their ends remote from the cylinder surface 11, in a slit 57, 58 of the respective base body 14, or short base bodies 16 to 18, and can be actuated by the force of springs 59, 61, for example compression springs, as shown in FIG. 2.

By its jamming surface or edge 63 extending in the axial direction, a top 62 of the third flap 52 is indirectly, i.e. with the interposition of a jamming roller 64, in an operative connection with the second groove wall 13, or with a "leading" suspension leg 24 of the plate 23, resting against the second groove wall 13. Here, the edge 63 of the top 62 of the third flap 52 is bent at approximately right angles, pointing in the direction of the second groove wall 13. The jamming roller 64 is supported by an upper lateral face 66 of the fourth flap 53. The base body 14 or the short base bodies 16 to 18 has a cutout 67 in the area of the jamming roller 64.

The clamping and/or jamming elements C, D, E are arranged in an axial length of each short base body 16 to 18, and therefore also in the one-piece base body 14, in such a way that the length of a short base body 16, 17 or 18 of 3 l corresponds to a number of lengths l, m, n of the clamping and/or jamming elements as seen in FIG. 4 and as follows:

$$3\ l = 4\ m \text{ for } C + 2\ n \text{ for } D + l \text{ for } E$$

The clamping and/or jamming elements C for the "trailing" suspension leg 07 or 26 are used with each jamming of the plates 02 or 23. When using a plate 02 and the direction of rotation A of the cylinder 01, the clamping and/or jamming elements D for the "leading" suspension leg 06 are additionally put into operation. But if a plate 23 is used when the cylinder 01 turns in the direction of rotation B, the clamping and/or jamming elements E are employed in place of the clamping and/or jamming elements D.

The base body 14, or the short base bodies 16 to 18, are preferably arranged in a manner fixed against relative rotation in the cylinder groove 03.

The inflatable air hose 42 extends, in one piece, over the entire length of the cylinder groove 03. On one of its ends, the air hose 42 is provided with a valve, for example, and is charged with compressed air when needed via a connection line, not specifically represented, to the cylinder journal, and by means of a known rotary lead-in.

If the device is intended to be brought from the plate holding position or position of rest, as depicted in FIG. 1 into the plate-removing, or operating position, as depicted in FIG. 3, the air hose 42 is charged with compressed air at a pressure of approximately six bar. The plates or flaps 27, 43 and 52, 53 are pivoted away from each other against the force of the springs 41, 51 and 59, 61. In the course of this, the suspension legs 06, 07, or 24, 26, are released as depicted in FIG. 3.

In accordance with a preferred embodiment, the force of the pressure of each spring 51, as well as each spring 59, 61, is respectively greater than the force of the pressure of the spring 41. Initially, the air hose 42 is charged with an air pressure of approximately three bar. Therefore the force of the pressure exerted by the air hose 42 is greater than the force of the pressure of the spring 41 and less than the force of the pressure of the springs 41, 59 or 61. The first flap 27 shown in FIGS. 1 and 3 is pivoted and the jamming surfaces 36, 37 come out of contact with the rear suspension leg 07, or 26. The "trailing" end can snap out of the fastening slit 09 because of the inherent tension of the plate 02, or 23 with its suspension leg 07 or 26 and can thereafter be grasped.

The result of increasing the air pressure in the air hose 42 to approximately six bar is that the force of the pressure exerted by the air hose 42 now is also greater than the force of the pressure of the springs 41, 59 or 61, so that the suspension leg 06, or 24, is also released.

While a preferred embodiment of a device for fixing a flexible plate, in accordance with the present invention, has been described fully and completely hereinabove, it will be apparent to one of skill in the art that a number of changes in, for example, the overall size of the cylinder, the specific type of flexible plates secured to the cylinder, and the like could be made without departing from the true spirit and scope of the present invention which is to be limited only by the following claims.

What is claimed is:

1. A cylinder of a rotary printing press in combination with a device for securing a flexible plate having suspension legs on the cylinder comprising:

a fastening slit in the cylinder;

a cylinder groove positioned radially inwardly of said fastening slit and connected with said fastening slit, said cylinder groove having a cylinder groove wall with an abutment;

a plurality of plate suspension leg fastening elements in said cylinder groove, at least one of said fastening elements being a pivotable flap; and at least one roller body in said cylinder groove, said roller body being positioned between said pivotable flap and said abutment, wherein one of the suspension legs is a leading suspension leg angled at an acute angle and further wherein the leading suspension leg can be placed between said roller body and said abutment.

2. The combination of claim 1 further including at least one base body arranged in said cylinder groove.

3. The combination of claim 2 wherein said at lease one base body has an opening and further wherein suspension leg engaging portions of said fastening elements project through said opening.

4. The combination of claim 2 wherein said at least one base body is c-shaped in cross section.

5. The combination of claim 2 wherein said at least one base body is comprised of a plurality of short base bodies extending in an axial direction of the cylinder and adapted to be coupled with each other.

6. The combination of claim 2 wherein said at least one base body is arranged in said cylinder groove fixed against rotation.

7. The combination of claim 1 further including an inflatable air hose, said inflatable air hose being adapted to bring said fastening elements out of operative contact with the suspension legs.

8. The combination of claim 1 further wherein said pivotable flap includes a cutout and said at least one roller body is located in said cutout on said pivotable flap.

* * * * *